US005242640A

United States Patent [19]

Butler et al.

[11] Patent Number: 5,242,640

[45] Date of Patent: Sep. 7, 1993

[54] PREPARING CATIONIC-DYEABLE TEXTURED YARNS

[75] Inventors: Michael D. Butler, Kinston, N.C.; Jerry T. Charles, Columbia; Lawrence S. Shea, Camden, both of S.C.; George L. Sivils, Jr., Chattanooga, Tenn.

[73] Assignee: E. I. Du Pont de Nemours and Company, Wilmington, Del.

[21] Appl. No.: 793,030

[22] Filed: Nov. 15, 1991

Related U.S. Application Data

[63] Continuation-in-part of Ser. No. 248,733, Sep. 26, 1988, abandoned, which is a continuation-in-part of Ser. No. 34,429, Apr. 3, 1987, abandoned.

[51] Int. Cl.[5] ..... D01F 8/14

[52] U.S. Cl. ..... 264/103; 264/171; 264/211.14; 264/237

[58] Field of Search ..... 264/103, 171, 211.12, 264/211.14, 237

[56] References Cited

U.S. PATENT DOCUMENTS

| | | | |
|---|---|---|---|
| 3,771,307 | 11/1973 | Pertille | 57/288 |
| 3,772,872 | 11/1973 | Piazza et al. | 57/243 |
| 4,059,949 | 11/1977 | Lee | 428/229 |
| 4,115,989 | 9/1978 | Spolnicki | 57/245 |
| 4,134,882 | 1/1979 | Frankfort et al. | 528/308.2 |
| 4,157,419 | 6/1979 | Mirhej | 428/373 |
| 4,195,051 | 3/1980 | Frankfort et al. | 264/211.14 |
| 4,233,363 | 11/1980 | Cemel et al. | 428/373 |
| 4,529,368 | 7/1985 | Makansi | 425/72.2 |
| 4,557,972 | 12/1985 | Okamoto et al. | 428/373 |

FOREIGN PATENT DOCUMENTS

| | | |
|---|---|---|
| 285437 | 10/1988 | European Pat. Off. . |
| 2335946 | 1/1975 | Fed. Rep. of Germany . |
| WO79/00149 | 3/1979 | PCT Int'l Appl. . |

*Primary Examiner*—Leo B. Tentoni

[57] ABSTRACT

A cationic-dyeable copolyester draw-texturing feed yarn of concentric sheath/core bicomponent filaments, with a sheath of cationic-dyeable polyester, and a core of homopolymer, whereby such feed yarn may be draw-textured on commercially-available machines to give cationically-dyeable textured yarns with a combination of good tensile properties, low broken filament counts and good bulk at economically viable cost.

2 Claims, No Drawings

PREPARING CATIONIC-DYEABLE TEXTURED YARNS

CROSS REFERENCE TO RELATED APPLICATIONS

This application is a continuation-in-part of parent application No. 07/248,733, filed Sep. 26, 1988 by Butler et al, now abandoned, itself a continuation-in-part of application No. 07/034,429, filed Apr. 3, 1987, also abandoned.

FIELD OF THE INVENTION

This invention concerns improvements in and relating to the preparation of improved draw-textured yarns that consist essentially of polyester filaments that are cationic-dyeable, and more particularly of such filaments that are concentric sheath/core bicomponent filaments.

BACKGROUND OF THE INVENTION

Synthetic polyester multifilament yarns have been known and used commercially for several decades, having been first suggested by W. H. Carothers, U.S. Pat. No. 2,071,251, and then by Whinfield and Dickson, U.S. Pat. No. 2,465,319. Most of the polyester polymer that has been manufactured and used commercially for such continuous filament yarns has been poly(ethylene terephthalate), sometimes referred to as 2G-T. This polymer is often referred to as homopolymer, although it is known that, in addition to the residues of ethylene, from ethylene glycol, and terephthalate residues, from dimethyl terephthalate or terephthalic acid, there are also residues from diethylene glycol. For textile (apparel) purposes, such commercial homopolymer is usually of intrinsic viscosity about 0.6; it can vary up to about 0.65 or even 0.67, and can also be of somewhat lower viscosity. Commercial homopolymer is notoriously difficult to dye. Such homopolymer is mostly dyed with disperse dyestuffs at high temperatures under elevated pressures, which is a relatively expensive and inconvenient process (in contrast to processes for dyeing several other commercial fibers at atmospheric pressure, e.g. at the boil), and so there have been several suggestions for improving the dyeability of polyester yarns.

Accordingly, Griffing and Remington, U.S. Pat. No. 3,018,272, suggested the use of cationic-dyeable copolyesters, in which the poly(ethylene terephthalate) structure is modified by inclusion of sulfonate groups that provide an affinity for cationic dyestuffs. Such cationic-dyeable copolyester consisting essentially of poly[ethylene terephthalate/ 5-(sodium sulfo) isophthalate] containing about 2 mole % of the 5-(sodium sulfo) isophthalate groups in the polymer chain has been used commercially as a basis for polyester yarns for some 20 years, and is sometimes referred to as 2G-T/SSI. Although this cationic-dyeable copolyester is significantly more expensive than the homopolymer, which is not cationic dyeable, and has also provided weaker fibers than does homopolymer, cationic-dyeable copolyester has been used on a large scale for various applications, especially as staple fiber, for spun yarns, because, in addition to the useful and improved dyeing capability of the copolyester, the individual fibers break more readily than 2G-T fibers, and this tendency to break is of great advantage in spun yarns, in providing improved pilling performance. In contrast, the lower strength has generally been a disadvantage of the cationic dyeable copolyester in filament yarns.

2G-T/SSI has also been used in heather multi-filament yarns, wherein cationic-dyeable copolyester filaments are intermingled with homopolymer filaments, that are not cationic dyeable. Heather yarns were disclosed by Reese in U.S. Pat. No. 3,593,513, and Lee in U.S. Pat. No. 4,059,949. Heather yarns were preferably made by cospinning the filaments so as to mix the filaments during their spinning.

The present invention is not concerned with heather yarns, i.e. yarns that contain significant amounts of differently-dyeable filaments, This invention is concerned only with a need to make useful textured yarns that consist essentially entirely of filaments that have cationic-dyeable characteristics.

A large amount of homopolymer has been used to make draw-textured polyester yarns from draw-texturing feed yarns (DTFY) that are substantially amorphous spin-oriented multi-filament (continuous filament) yarns prepared by spinning at withdrawal speeds of the order of about 3000 ypm or more. This concept was first suggested by Petrille in U.S. Pat. No. 3,771,307 and Piazza and Reese in U.S. Pat. No. 3,772,872.

As indicated, conventional homopolymer DTFY has been manufactured in large quantities and has been draw-textured. Hitherto, however, although 2G-T/SSI copolymer has been used satisfactorily for many years to make other types of polyester yarns as indicated, customers have complained about DTFY from 2G-T/SSI and about the results of texturing DTFY made from 2G-T/SSI copolyester. Despite many efforts over the years hitherto, it has not proved possible to improve 2G-T/SSI copolyester DTFY to meet customer requirements in this regard at an economic price.

It is an object of the invention to provide a cationic-dyeable copolyester DFTY that meets such requirements. In other words, the problem has been to provide DTFY that consists essentially of filaments having cationic-dyeability, but that does not give rise to the defects complained of heretofore.

Cemel et al., U.S. Pat. No. 4,233,363, disclosed heather DTFY. In other words, Cemel required a mixed filament DTFY, that must have two different types of spin-oriented filaments, one type being of a cationically-dyeable copolymer and the other being differently dyeable, namely homopolymer. Most of Cemel's disclosure is about the need for intimate mixing (measured as high DFI) and closely matching elongations of the two different components (so as to get the desired heather). All Cemel's working Examples cospin conventional (monocomponent) filaments of the two types of differently dyeable filaments. In column 10, lines 54–57, Cemel adds that, if desired, some of the filaments may be of a sheath-core structure, as disclosed, e.g. in Lee, referred to above. As indicated already, the present invention is not concerned with heather yarns.

Reference is also made to EP A2 0285437, which discloses an improved cationic-dyeable DTFY of concentric sheath/core bicomponent filaments, with a sheath of 2G-T/SSI copolyester and a core of 2G-T homopolymer. Further reference will be made to this hereinafter, as an object of the invention is to provide a further improvement, beyond that disclosed specifically in the Examples of EP A2 0285437.

SUMMARY OF THE INVENTION

According to one aspect of the invention, there is provided a process for preparing a yarn consisting of spin-oriented cationic-dyeable copolyester filaments, wherein concentric sheath/core bicomponent filaments, whose core consists essentially of poly (ethylene terephthalate) of intrinsic viscosity about 0.6, and whose sheath consists essentially of poly[ethylene terephthalate/5-(sodium sulfo)isophthalate] containing about 2 mole % of the 5-(sodium sulfo)isophthalate groups in the polymer chain, are melt-spun through capillaries and quenched by cooling gas at a withdrawal speed of the order of about 3 Km/min or more, and wherein the molten filamentary streams emerging from the capillaries are shielded from the cooling gas by a screen and/or a solid shield, and wherein the spin-oriented filaments are interlaced and wound into a package.

According to another aspect, there is provided a process for preparing a textured yarn consisting of cationic-dyeable copolyester filaments, wherein a package of yarn of spin-oriented bicomponent filaments is prepared according to the process of claim 1, and said package of yarn is used as a feed yarn in a draw-texturing process to prepare the textured yarn.

According to another aspect, there is provided an improved draw-texturing feed yarn, consisting of spin-oriented cationic-dyeable copolyester filaments, wherein the cationic-dyeable copolyester consists essentially of poly[ethylene terephthalate/ 5-(sodium sulfo)isophthalate] containing about 2 mole % of the 5-(sodium sulfo)isophthalate groups in the polymer chain, the feed yarn is a substantially amorphous spin-oriented multi-filament yarn prepared by spinning the filaments at a withdrawal speed of the order of about 3 Km/min or more, and the filaments are concentric sheath/core bicomponent filaments, wherein the sheath consists essentially of the cationic-dyeable copolyester, and the core consists essentially of poly(ethylene terephthalate) of intrinsic viscosity about 0.6, and wherein the filament structure is such that the differential birefringence between the filament surface and the filament core is not more than about 0.013.

According to another aspect, there is provided a false-twist textured polyester yarn consisting of cationic-dyeable copolyester filaments, wherein the cationic-dyeable copolyester consists essentially of poly[ethylene terephthalate/5-(sodium sulfo)isophthalate] containing about 2 mole % of the 5-(sodium sulfo)isophthalate groups in the polymer chain, such filaments being concentric sheath/core bicomponent filaments, wherein the sheath consists essentially of the cationic-dyeable copolyester, and the core consists essentially of poly(ethylene terephthalate) of intrinsic viscosity about 0.6, and having a tenacity of at least about 2–5 gpd and an elongation of at least about 20%.

DETAILED DESCRIPTION OF THE INVENTION

The preparation of monocomponent polyester DTFY has been amply described in the prior art, e.g. in the aforesaid U.S. Pat. Nos. 3,771,307 and 3,772,872, the disclosures of which are hereby incorporated by reference. These conventional techniques need to be modified by providing for the spinning of concentric bicomponent filaments, for example, by using a spinneret of the type disclosed on the left hand side of FIG. 1 of aforesaid U.S. Pat. No. 4,059,949 (Lee), the disclosure of which is also hereby incorporated by reference; (it must be recognized that Lee's process and apparatus is restricted to the preparation of mixed filament yarns; i.e. Lee makes not only drawn concentric bicomponent filaments (but also monocomponent drawn filaments, whereas such mixed filament yarns are not the concern of the present invention; and Lee does not make DTFY). The preparation of bicomponent filaments for polyester DTFY is disclosed in Mirhej, U.S. Pat. No. 4,157,419, it being recognized that Mirhej discloses the preparation of eccentric bicomponent filaments that are intended to break during draw-texturing and provide a helical crimp, on account of the eccentric nature, whereas the bicomponent filaments according to the present invention are concentric, and are intended to resist breaking during normal draw-texturing operations. Details of preparing wholly bicomponent (concentric) multifilamentary yarns are also given in EP A2 0285437, the disclosure of which is also incorporated herein by reference. Further details for preparing preferred concentric bicomponent filaments and DTFY according to the present invention are given in the following Examples, as are details of their texturing.

The preparation of fabrics and garments from the resulting textured yarns may be carried out by conventional techniques, as disclosed in the art, e.g. in the following Bulletins, published as indicated, and available from the Textile Fibers Department, Technical Services Section, E. I. du Pont de Nemours and Company, Wilmington, Delaware, 19898, relating to Dacron polyester fiber, Bulletin D-244, August, 1970, Bulletin D-281, June, 1974, Bulletin D-295, December, 1976, Bulletin D-296, December, 1976, and Bulletin D-300, December, 1977.

The advantages of improved (reduced) BFC and of increased bulk obtained in comparison with monocomponent 2G-T/SSI copolymer filament yarns are quite significant. A further advantage is that the cost of the homopolymer, that provides the core of the novel bicomponent filaments, is considerably cheaper than for the 2G-T/SSI copolymer, so the cost of the raw materials for the bicomponent filaments is considerably less than for monocomponent filaments of 2G-T/SSI.

The invention is further described and illustrated in the following Example, in which important advantages in tensile properties are demonstrated. Reference may be made to Knox, U.S. Pat. No. 4,156,071 for most of the various test measurements. For the tensile properties, however, there was used a six-inch sample length, without twist at a 200% per minute rate of extension. "Natural Draw Ratio" (NDR) is determined from a stress-strain curve as described by Ludewig in *Polyester Fibres*, Section 5.4.1 (pages 174–177), John Wiley & Sons, Ltd., 1971. "Natural Draw Force" (NDF) is the value of the tensile stress on the yarn taken from the straight-line portion of the stress-strain curve located in the yield zone below the natural draw ratio. As reported here, NDR and NDF are determined from a stress-strain curve measured on an Instron tensile testing machine at 703F and 65% RH using a sample length of five inches and a rate of elongation of 400% per minute. Crimp Contraction ($CCA_5$) and differential birefringence were measured essentially as in Frankfort et al., U.S. Pat. No. 4,134,882. The method for determining LRV is disclosed in Most, U.S. Pat. No. 4,444,710.

EXAMPLE 1

A). A 245/34 bicomponent feed yarn was prepared essentially as described and illustrated in Lee U.S. Pat. No. 4,059,949 at a withdrawal speed of 3550 ypm, but with all filaments being 50/50 by weight of 2G-T of 19.4 LRV (intrinsic viscosity 0.61) in the core and with 98/2 2G-T/SSI copolyester of 13.0 LRV (intrinsic viscosity 0.49) in the concentric sheath, using a block temperature of 286 C. The filaments were treated with a commercial draw-texturing finish and interlaced. The resulting yarns had the following properties, Tenacity 1.3 g/d, Elongation 117%, Modulus 24 g/d, Natural Draw Ratio 1.4, Natural Draw Force 150 g, Shrinkage 45%, Density 1.347 and Birefringence 0.02. This yarn was textured on a Barmag FK-6-900 texturing machine at a speed of 600 m/min, and the textured yarn properties are compared in Table 1A with those of a similarly textured commercial monocomponent 98/2 2G-T/SSI copolyester yarn of 13.0 LRV.

TABLE 1A

| | BICOM-PONENT A | MONOCOM-PONENT A |
|---|---|---|
| CCA5 % | 8.9 | 6.2 |
| BFC (FRAY COUNT) | 4 | 10 |
| TENACITY GPD | 2.3 | 2.8 |
| ELONGATION % | 18.7 | 25.5 |

These show significant advantages in bulk (crimp contraction, CCA5) and broken filament count (BFC) for the bicomponent yarn over the monocomponent yarn, but unfortunately, the tensile properties of the bicomponent yarn are significantly worse than those of the monocomponent yarn, (which are already poor, in comparison with those of homopolymer 2G-T yarns). When differential birefringence (birefringence of the filament surface minus that of the core of the filament) for the bicomponent filaments was measured, this was determined to be 0.015, whereas differential birefringence for the monocomponent was only 0.004.

B.) Accordingly, a different 245/34 bicomponent feed yarn was prepared using a withdrawal speed of 3345 ypm, with 50/50 by weight of 2G-T of 19.3 LRV (intrinsic viscosity of 0.61) in the core and with 98/2 2G-T/SSI copolyester of 13.0 LRV (intrinsic viscosity of 0.49) in the concentric sheath, using a block temperature of 284 C. This time, however, a 5 inch length of 30×30 mesh screen wire was used according to the invention to surround the filament bundle as the molten filamentary streams emerged from the spinneret (using an arrangement similar to that described and illustrated in U.S. Pat. No. 4,529,368) thus partially shielding the emerging filamentary streams from the cross-flow cooling air for such a distance of approximately 5 inches below the spinneret. Spinning conditions were otherwise again essentially as described and illustrated in Lee, U.S. Pat. No. 4,059,949. This feed yarn was also textured on a Barmag FK-6-900 texturing machine at a speed of 600 m/min and the properties of the resulting textured yarn are compared in Table IB with those of a similarly textured commercial monocomponent 98/2 by weight 2G-T/SSI DTFY, and the results are shown in Table 1B.

TABLE 1B

| | BICOM-PONENT B | MONOCOM-PONENT B |
|---|---|---|
| CCA5 % | 7.2 | 6.1 |
| BFC (FRAY COUNT) | 2.25 | 6.25 |
| TENACITY, GPD | 2.6 | 2.6 |
| ELONGATION | 23.6 | 20.2 |

As can be seen, this bicomponent yarn exhibited not only improvements in broken filament count (BFC) and bulk (CCA5) over the monocomponent, but also had tensile properties that were improved over those of bicomponent A, and essentially equivalent to those of the monocomponent yarn. The differential birefringence of this bicomponent B feed yarn was determined to be 0.013 (in contrast to 0.015 for bicomponent A). It is surprising that such a small reduction in birefringence of the feed yarn has so significantly improved the tensile properties of the textured bicomponent yarn, so that they are comparable to those of the monocomponent yarn whose differential birefringence (of the monocomponent B feed yarn) was 0.004 (like that of monocomponent A).

For convenience of comparison, Table 1C combines Tables 1A and 1B and shows a significant advantage in using bicomponent filaments (B), according to the invention, over bicomponent filaments (A), so far as tensile properties are concerned, while retaining significant advantages in improved bulk and lower BFC over monocomponent filaments (A or B)

TABLE 1C

| | BI-COMPONENTS | | MONO-COMPONENTS | |
|---|---|---|---|---|
| | A | B | B | A |
| Textured Yarns | | | | |
| CCA5, % | 8.9 | 7.2 | 6.1 | 6.2 |
| BFC | 4 | 2.25 | 6.25 | 10 |
| TENACITY, GPD | 2.3 | 2.6 | 2.6 | 2.8 |
| ELONGATION, % | 18.7 | 23.6 | 20.2 | 25.5 |
| Feed Yarns | | | | |
| Birefringence | 0.015 | 0.013 | 0.004 | 0.004 |

Accordingly, the present invention solves a difficulty observed with bicomponent filaments A that were prepared according to EP A2 0285437, referred to above.

It will be noted that the delayed quenching arrangement in Example 1B provides a significant advantage over Example 1A, as disclosed above. Such delayed quenching is preferably obtained as disclosed in Makansi in U.S. Pat. No. 4,529,368, the disclosure of which is hereby incorporated by reference, but may be obtained by alternative means.

We have demonstrated that textured bicomponent yarns of the invention are obtainable with significantly more bulk than the comparison monocomponent yarns. This is an important advantage, since an increase in bulk in textured yarn translates into appreciably more stretch in a fabric (and in garments) which is very desirable.

The Example has illustrated feed yarns of approximately 7 denier per filament (dpf), and it should be noted that the present invention can also be applied to preparing of feed yarns of higher and lower dpf. In fact, the present invention is expected to be at least as effective in providing improved tensile properties of bicomponent yarns of dpf of about 5 or less.

As indicated, the sheath/core (DTFY) filaments in the foregoing Example contained about 50/50 by weight of homopolymer/copolymer, and correspondingly about equal amounts by area of cross-section, since the densities are approximately equal. The diameter of the core (which is the same as the internal diameter for the sheath) was about 10.5 microns, whereas the external diameter of the sheath (and of the total filament) was about 15 microns. In other words, the thickness of the sheath (on either side) was only about 2 microns. A decrease in the thickness of the sheath in the feed yarn may lead to more bulk in the textured product, and possibly lower broken filaments and lighter dyeing. Increased dyeing capability could possibly be achieved by increasing the proportion of SSI in the copolyester used for the sheath, if desired. Thus, although this Example has demonstrated use of the 2G-T/SSI copolymer that has been preferred for many years and has been available commercially, it will be understood that variations of the precise compositions and proportions of the polymers and of their conditions of preparation can be made without departing from the essence of the invention, both for the copolymer sheath and for the homopolymer core of bicomponent filaments and yarns, according to the present invention. For instance, the viscosity of the homopolymer may vary from about 0.6 to about 0.67. It is also conventional to use additives, such as pigments or delustering agents, such as titanium dioxide, if desired.

We claim:

1. A process for preparing a yarn consisting of spin-oriented cationic-dyeable copolyester filaments, wherein concentric sheath/core bicomponent filaments, whose core consists essentially of poly(ethylene terephthalate) of intrinsic viscosity about 0.6, and whose sheath consists essentially of poly[ethylene terephthalate/5-(sodium sulfo)isophthalate] containing about 2 mole % of the 5-(sodium sulfo)isophthalate groups in the polymer chain, are melt-spun through capillaries into molten filamentary streams that are quenched by cooling gas to form the filaments that are spun at a withdrawal speed of the order of about 3 Km/min or more, and wherein the molten filamentary streams emerging from the capillaries are shielded from the cooling gas by a screen and/or a solid shield, whereby the filament structure is such that any differential birefringence between the filament surface and the filament core is not more that about 0.013, and wherein the spin-oriented filaments are interlaced to form an interlaced yarn that is wound into a package.

2. A process for preparing a textured yarn consisting of cationic-dyeable copolyester filaments, wherein a package of yarn of spin-oriented bicomponent filaments is prepared according to the process of claim 1, and said package of yarn is used as a feed yarn in a draw-texturing process to prepare the textured yarn.

* * * * *